United States Patent [19]

Dansie et al.

[11] Patent Number: 4,556,199

[45] Date of Patent: Dec. 3, 1985

[54] ELECTRIC WINCH APPARATUS

[76] Inventors: Ryan F. Dansie, 353 S. 1000E., Kaysville, Utah 84307; Wendell Holmes, Box 104, Liberty, Utah 84310; Denzil B. Baird, 76 S. 300W., Brigham City, Utah 84302

[21] Appl. No.: 610,899

[22] Filed: May 16, 1984

[51] Int. Cl.[4] ..... B66D 5/30; B66D 1/46; B66D 1/12

[52] U.S. Cl. ..... 254/348; 188/171; 192/12 D; 254/362; 254/375

[58] Field of Search ..... 254/346, 347, 349, 355, 254/362, 365, 366, 368, 375, 378; 88/171; 192/12 D

[56] References Cited

U.S. PATENT DOCUMENTS

| | | | |
|---|---|---|---|
| 2,512,017 | 6/1950 | Hayes | 254/362 |
| 2,848,087 | 8/1958 | Simson et al. | 192/144 |
| 2,936,579 | 5/1960 | Reed | 60/35.6 |
| 3,516,525 | 6/1970 | Skaggs | 192/4 |
| 3,543,891 | 12/1970 | Mathers | 192/0.094 |
| 3,784,165 | 1/1974 | Pruitt | 254/362 |
| 3,830,344 | 8/1974 | Cervenec et al. | 188/171 |
| 4,306,640 | 12/1981 | Morgan | 192/0.094 |
| 4,361,312 | 11/1982 | Schreyer et al. | 254/362 |

*Primary Examiner*—Billy S. Taylor

*Attorney, Agent, or Firm*—Donald J. Singer; Gerald B. Hollins

[57] ABSTRACT

A drum winch apparatus having an alternating current motor and direct current operable clutch and brake coils together with a control circuit for energizing these member is disclosed. The control circuit includes alternating current switching of DC current flows, operator control of both reeling in and unreeling drum functions, and selected use of separate brake release and brake hold off coils with a combination of full wave and half wave energizing currents.

10 Claims, 3 Drawing Figures

ELECTRIC WINCH APPARATUS

RIGHTS OF THE GOVERNMENT

The invention described herein may be manufactured and used by or for the Government of the United States for all governmental purposes without the payment of any royalty.

BACKGROUND OF THE INVENTION

This invention relates to the field of electrically operated hoisting and pulling apparatus and electrical control circuits associated with such apparatus.

Electrically operated hoisting and pulling devices and the control apparatus used with such devices have been continuously improved in the electrical art since the inception of electric motors. Generally devices of this type consist of an electric motor coupled through mechanical gearing to a flexible tension member such as a chain or rope or cable which can in turn be attached to a load object. In many applications the hoisting and pulling apparatus also includes mechanical clutch and brake members which allow precise control over the hoisting or pulling motion and also eliminate coasting and reverse movement under the influence of heavy loads. Generally hoisting and pulling apparatus of this type may be designed to employ a variety of electrical energy sources including direct current, alternating current, multiphase alternating current and combinations of these energy sources.

A particular form of hoisting and pulling apparatus which is found useful with heavy loads and long distances in an out-of-doors environment is commercially available as a Beebe (TM) winch; the name Beebe is used by Beebe International Inc. of Seattle, Wash. as a trademark. The winch embodied in the present invention includes a winding drum and steel cable and is usable in pulling loads over relatively large distances as might be needed for transferring guided missiles between a hauling trailer and a holding or launching facility for example. Other uses of the invention are of course possible.

The control circuit portion of the invention can of course be used with other types of hoisting and pulling apparatus and with other forms of motor driven equipment which require precise starting and stopping characteristics and retention of an attained position of the driven load. Uses such as machine tool component positioning, radio antenna positioning, and material feeding operations are examples of such alternate uses.

SUMMARY OF THE INVENTION

An object of the present invention is to provide a simple and low cost winch apparatus that is suitable for use in handling guided missiles and similar military hardware.

Another object of the invention is to provide a winch apparatus wherein a combination of half-wave and full wave rectified alternating current is used for energizing a direct current control element.

Another object of the invention is to provide a winch control apparatus wherein long life reliable operation of the switching components used with direct current inductive loads.

Yet another object of the present invention is to provide a winch control which does not require the use of free-wheeling diodes in the switching of direct current inductive loads.

DETAILED DESCRIPTION

Figure 1:
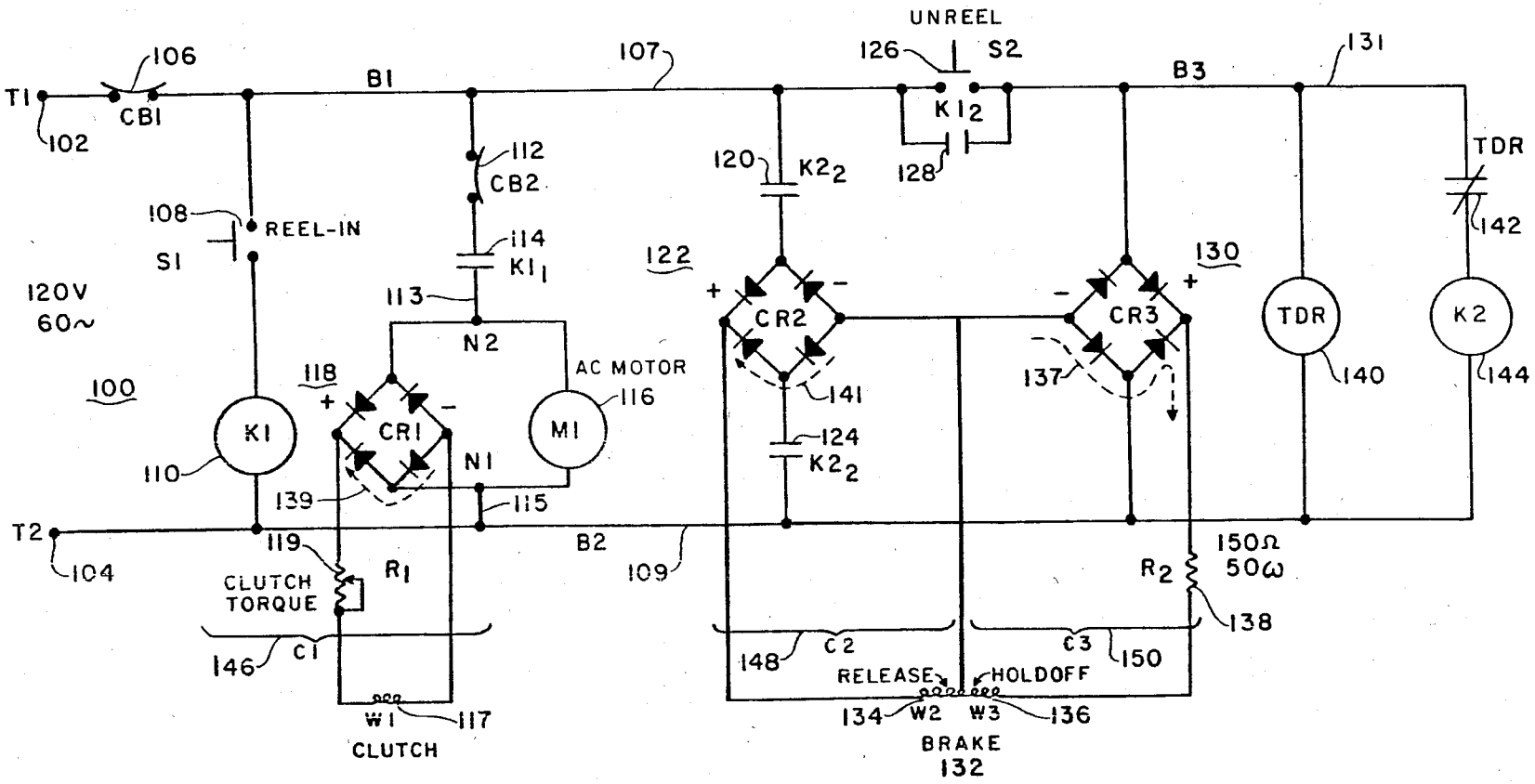
FIG. 1 is an electrical schematic diagram for an improved winch.

Referring now to FIG. 1 of the drawings, there is shown an schematic diagram of the electrical components used in a preferred embodiment winch apparatus. The FIG. 1 drawing shows, in electrical form, an alternating current winch drive motor 116 which is coupled to a gear mechanism by way of an electrically operated clutch having a clutch magnetic winding 117. The FIG. 1 winch also includes a magnetically operated brake, actuated by a brake coil or winding 132, and a pair of operator control push button contacts 108 and 126.

The FIG. 1 apparatus further includes a source of alternating current energy 100, connected to the FIG. 1 components by way of the terminals 102 and 104; the contacts of a pair of current limiting circuit breakers 106 and 112; a first control relay or contactor, including a coil or winding 110 and pairs of electrically isolated contacts 114 and 128.

FIG. 1 further includes three alternating to direct current rectifiers 118, 122, and 130. A variable electrical resistance or rheostat 119, a fixed electrical resistor of selected value 138, a second control relay or contactor having a coil 144 and contact pairs 120 and 124 and a time delay relay having a actuating member such as a coil or winding 140 and a pair of normally closed contacts 142.

Each of the components in FIG. 1 is identified with a secondary symbol which is generally in accord with practice in the control circuit and electrical art and as an aid to understanding the invention. These secondary symbols include the identification S1 and S2 for the spring-biased push buttons 108 and 126, the symbol M1 for the drive motor 116, the symbol CR1–CR3 for the rectifier 118, 122, and 130. Other secondary symbols for the FIG. 1 components include R1 and R2 for the resistors 119 and 138, the symbols K1 and K2 with appropriate subscript for the coil and contact pairs of the control relays or contactor means, and the symbol TDR for the elements associated with the time delay relay 140 and 142. FIG. 1 also includes the three indicators 146, 148 and 150 which generally identify three major electrical circuits present in the FIG. 1 diagram; the circuits identified by the indicators 146–150 are also identified by the symbols C1–C3.

Figure 2:
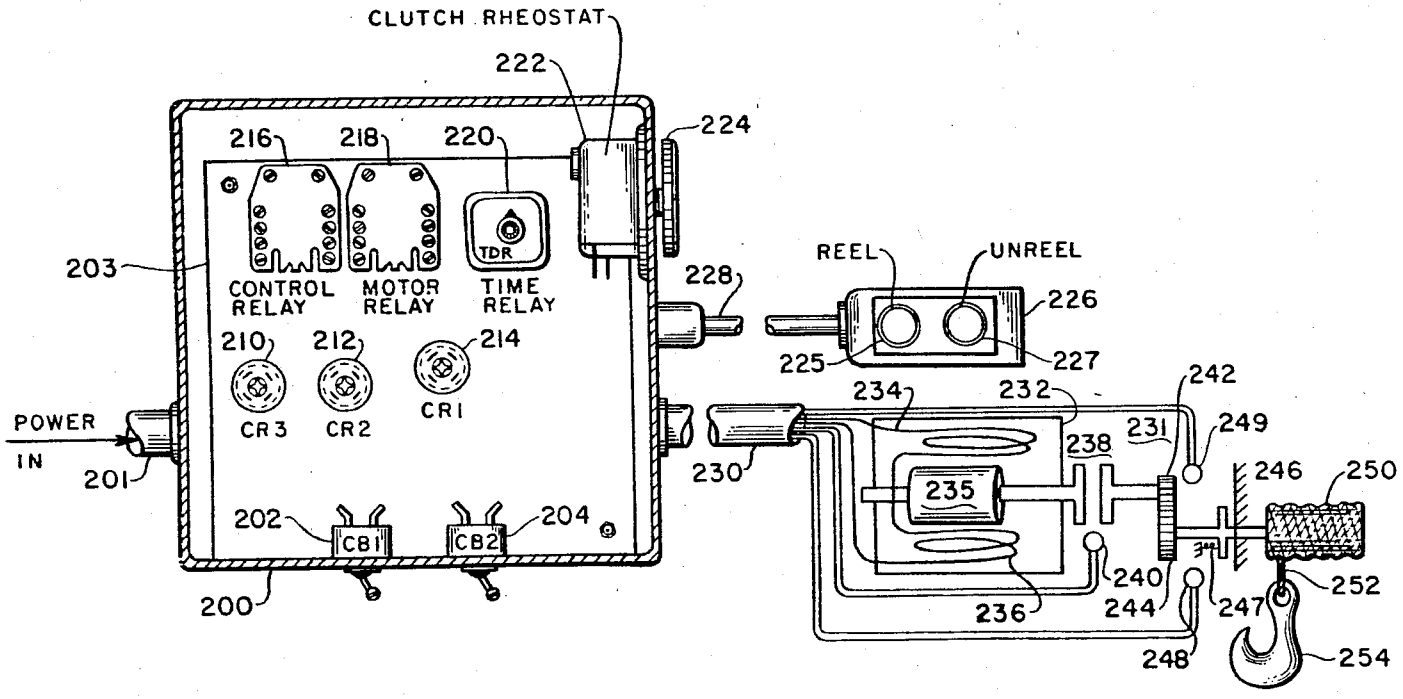
FIG. 2 is a mechanical element layout diagram of the winch.

Functioning of the FIG. 1 components can be better understood with the aid of FIG. 2 which shows both a mechanical layout of the FIG. 1 components in a typical practical embodiment of the invention and shows certain of the FIG. 1 components located in symbolic relationship with winch components. In FIG. 2, a cabinet or box 200 which is suitable for mounting on a wall or other surface is shown to contain a component mounting board 203 used for holding certain of the electrical components in a fixed adjacent position and to permit removal of these components as a unit for inspection and repair.

The FIG. 2 components include a pair of circuit breakers 202 and 204 whose contacts were shown at 106 and 112 in FIG. 1, three rectifier packages 210, 212, 214 whose electrical elements were shown at 130, 122 and 118 in FIG. 1 and two control relays or contactors 216, and 218 which were identified with the secondary symbols K1 and K2 in FIG. 1. FIG. 2 also shows the time delay relay 220 which is identified as TDR in FIG. 1 and the variable resistor or rheostat 222 which is shown electrically at 119 in FIG. 1. Also shown in FIG. 2 is an operators control 226 which includes push buttons 225 and 227, having the contacts 108 and 126 in FIG. 1, and a power cable 201 used to convey alternating current energy from the source 100 in FIG. 1.

At 231 in FIG. 2 is shown a diagramatic representation of the mechanical components of the preferred embodiment winch; these components include the motor 232 having coils or windings 234 and 236, and a rotor 235, an electrically actuated clutch 238 which is controlled by an engagement winding or coil 240, shown electrically at 117 in FIG. 1. The winch also includes a typical gear train which is comprised of the gear members 242 and 244, and an electrically released brake mechanism 246 which includes a brake application spring 247, a release coil 248 and a hold off coil 249, these coils are shown electrically at 134 and 136 in FIG. 1. The FIG. 2 apparatus also shows the winch pulling cable 252 and its take-up drum 250 and a cable terminating member such as the hook 254. Electrical cables used to tether the control head 226 and the winch 231 to the cabinet 200 are indicated at 228 and 230 in FIG. 2.

Functioning of the FIG. 1 and FIG. 2 apparatus anticipates that the operator will need to first unreel a portion of the pulling cable 252 from the drum 250 in FIG. 2 in order that an attachment of the terminating member 254 to a load such as the contemplated missile weapons be possible. To achieve the unreeling operation, a push button on the control head 226, the button 126 in FIG. 1, is closed in order that current be applied through rectifier 130 to the hold off portion 136 of the brake coil 132. Closure of the push button 126 also applies power to the coil 144 and thereby closes the contact pairs 120 and 124 to apply power to the rectifier 122 and thence to the release portion 134 of the brake coil 132. It is contemplated that current flow in the release coil portion 134 be larger than that in the hold off coil portion 136 by way of the design of the coils 134 and 136 and by way of resistor 138 which has a predetermined value near 150 ohm and 50 watts in the preferred embodiment of the invention.

Current flow in the release coil portion 134 is sufficient to commence releasing movement of the brake mechanism not withstanding the large air gap in the magnetic circuit of the brake mechanism in its unenergized position. Current in the release coil portion 134 is however too large for sustained application if overheating and physical damage is to be avoided. The lower current and different design of the hold off coil portion 136 overcomes this heating problem, this coil portion being capable of continuous operation without damage. The duration of the large release current in the coil portion 134 is determined by the time delay relay 220 in FIG. 2: the coil 140 and the contact 142 in FIG. 1 are parts of this time delay relay. Upon expiration of the time delay relay time interval, which in the preferred embodiment is near ½ second, the contacts 142 open causing the coil 144 to become deenergized and the contacts 120 and 124 to fall open and deenergize the release coil portion 134. Unreeling of the pulling cable 252 can continue so long as the push button contacts 126 remain closed and the hold off coil portion 136 is thereby energized.

Once the desired length of pulling cable has unreeled and attachment to the load is made, the operator can begin pulling or reeling in the load by depressing the push button 225 thereby closing the contacts 108 in FIG. 1. Closure of the contacts 108 energizes the coil 110 and thereby closes the contact pair 114 to apply power to the winch drive motor 116 and to the clutch magnetic winding 117 by way of the rectifier 118. Energization of the coil 110 also releases the brake mechanism by way of the contact pair 128 which enables the release events described above following closure of the push button contacts 126. Protection of the winch mechanism against reeling in of the entire pulling cable or unwinding of the entire pulling cable is accomplished by prior art apparatus which is not shown in FIG. 1 or FIG. 2.

The circuit breaker 204 in FIG. 2, includes the contacts 112 in FIG. 1, and protects the drive motor 116 and the clutch winding 117 from the flow of excessive current which might occur in the event of a fault in either of these devices and also protects against an excessive load applied to the winch by way of the pulling cable 252. In similar fashion circuit breaker contacts 106 protect the overall winch apparatus from excessive current flow in the event of component faults or other high current conditions. An alternate embodiment of the FIG. 1 diagram could be achieved by relocating the circuit breaker contacts 106 to the right of the circuit 112 in the conductor 107 in order that only low current magnitudes flow in the contacts 106 and use of a lower current rated circuit breaker capable of protecting the nondrive motor components be possible.

The brake coil 132 in FIG. 1 is shown embodied as a single coil having release and hold off portions 134 and 136 with a common tap or common lead wire in lieu of four individual leads for the two coil portions. The selection of three lead or four lead brake coil is a matter of convenience, however the illustrated three lead configuration eliminates one conductor in the tether cable 230. The three lead coil requires the common connection of one terminal of the rectifiers 122 and 130 and results in the use of 2 contact pairs as shown at 120 and 124 in lieu of a single contact pair for the rectifier 122.

Adjustment of the brake hold off current magnitude is accomplished in accordance with the requirements of the hold off mechanism and is achieved by adjusting the value of resistor 138. Some embodiments of the FIG. 1 apparatus could omit the resistor 138 where the hold off coil portion 136 is capable of operating over a long time period when impressed with the full DC ouput of rectifier 130. The phrase "connected with" is used herein in referring to an arrangement of this type wherein a connection can be made either with or without an intermediate element. According to this convention, therefore, the hold off coil 136 could be described as connected with a source of energy regardless of whether the resistor 138 is present or absent. Current adjustment in the clutch winding 117 is similarly achieved by way of the variable resistor 119, this adjustment allows a determination of the maximum torque transmitted by the clutch 238. A knob 224 in FIG. 2 permits operator varying of the clutch current and is shown attached to the physical embodiment 222 of the rheostat 119.

Certain of the conductors and current transmission nodes in FIG. 1 are also identified with supplementary symbols—in the manner described earlier for components in FIG. 1 and for convenience in describing and discussing the FIG. 1 apparatus; these symbols include the identification B1-B3 for the conductors 107, 131 and 109, B1-B3 being abbreviations for the name bus 1, bus 2 and bus 3. The term bus refers to a common potential conductor used to distribute energy to a plurality of load devices. The symbols N1 and N2 at the ends of conductors of 113 and 115 refer to electrical nodes and are used below in describing the circuit.

It should be noted in FIG. 1 that alternating current switching of direct current loads is achieved for both the clutch coil 117 and the brake coil 132. Alternating current switching of these inductive loads together with provision of an inductive kick discharge path through the bridge rectifiers 118, 122 and 130 following deenergization of the AC supply prevents the occurrance of large voltages and excessive arcing at the opening of the contacts pairs 114, 120 and 124. This arrangement prolongs the operating life and reliability of these contact pairs and prevents the developing of large coil voltages which could possibly damage coil insulation.

Half-wave or other rectifier arrangements can be used in lieu of the rectifiers 118, 122, and 130, however the illustrated full wave bridge circuits are to be preferred because of their symmetrical loading of the alternating energy supply and because of their ability to suppress the inductive voltage spike which occurs when the current in an inductive circuit is interrupted. It should be noted that AC switching located ahead of the rectifiers 118, 122 and 130 expressly provides the inductive spike discharge paths 137, 139 and 141 and thereby eliminates a need for separate free-wheeling diode to suppress this inductive spike.

Figure 3:
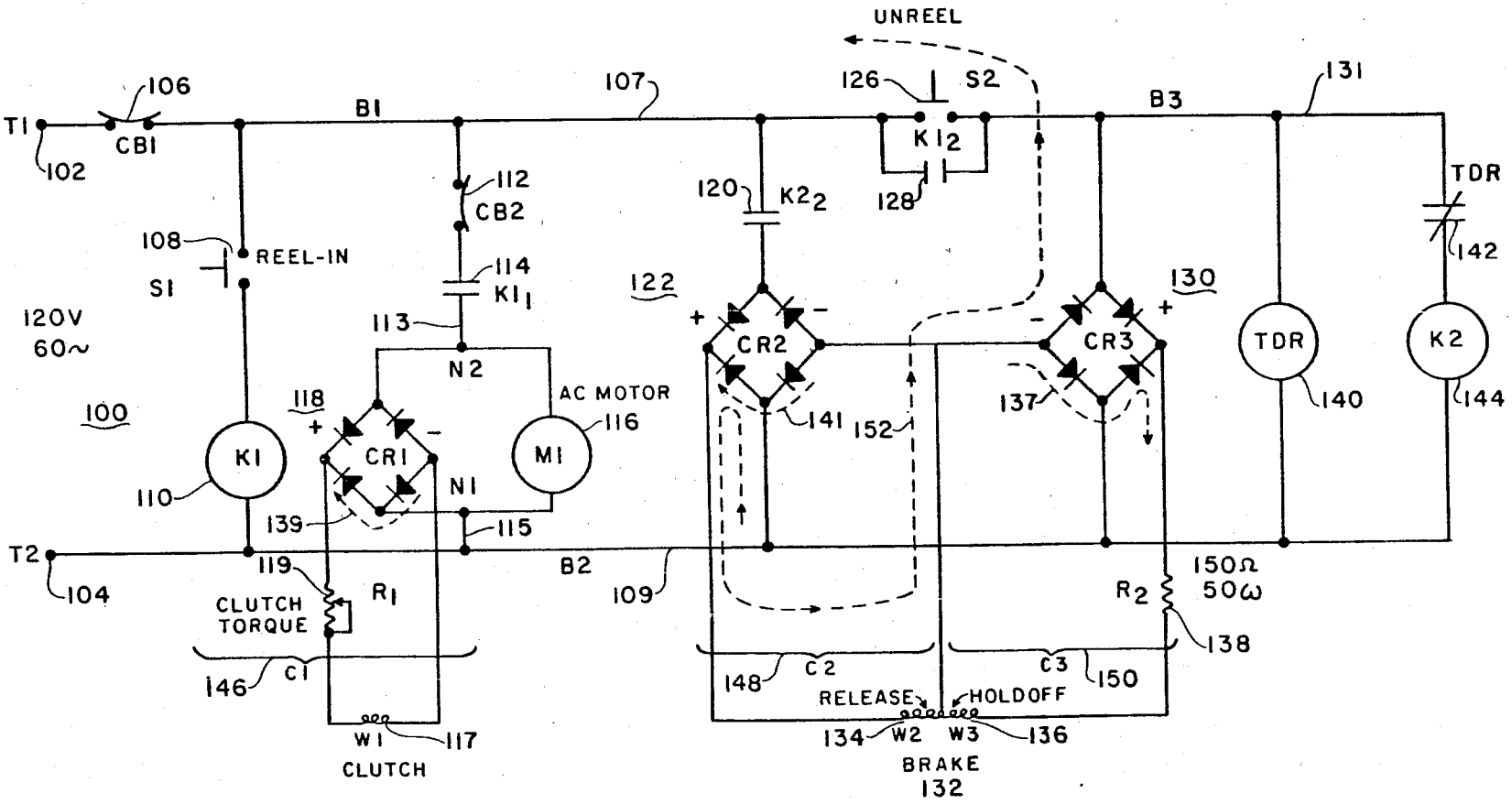
FIG. 3 is an alternate embodiment of the FIG. 1 winch electrical schematic diagram.

A useful alternate embodiment of the FIG. 1 apparatus is shown in FIG. 3 of the drawings. The FIG. 3 apparatus is achieved by omitting the contact pair 124 from the FIG. 1 apparatus and is conveniently explained by adding the current path indication 152 in FIG. 3. With this FIG. 3 arrangement the brake coil release portion 134 will receive half wave current flow during energization of the hold off coil portion 136 by way of a combination of diodes in the rectifiers 122 and 130. This half-wave energization may be desirable where the properties of the brake mechanism and the release and hold off coil portions require a more pulsating magnetic flux or alternately more magnetic flux than can be conveniently developed with the hold off coil alone. The current path by which this half-wave current flow in the release coil portion occurs during hold off coil energization is shown at 152 in FIG. 3. The path 152 is active only during the alternating current cycles which make the B2 bus positive with respect to the B1 bus because of one-way current flow in the bridge rectifier diode elements. Half-wave energization of the release coil portions could be desirable, for example, in preventing sticking or binding of the brake mechanism since the half-wave pulses would have a large 30 Hz frequency component; energization at this low frequency tends to provide shaking or vibrating of the brake mechanism and thereby promote the movement of a sticking mechanical component.

While the apparatus and method herein described constitute a preferred embodiment of the invention, is to be understood that the invention is not limited to this precise form of apparatus or method and that changes may be made therein without departing from the scope of the invention which is defined in the appended claims.

We claim:

1. Winch apparatus comprising:

a drum and cable member having a motor (M1) with electrically energizable windings, a clutch with an electrically energizable engagement winding (W1) and a brake with an electrically energizable release winding (W2) and an electrically energizable hold off winding (W3);

a source of alternating current energy including first and second supply terminals (T1,T2);

a first bus conductor (B1) connected with said first supply terminal;

a second bus connector (B2) connected with said second supply terminal;

a first manually closeable spring return switch member (S1) and a first contactor coil (K1) electrically connected in series therewith, said series connected switch and coil being connected across said first and second bus conductors;

a first electrical rectifier (CR1) having alternating current terminals connected in parallel with said motor windings at a pair of electrical nodes (N1,N2) and direct current output terminals connected with said clutch engagement winding, one of said electrical nodes being connected with said second bus conductor;

first electrical contact means including a pair of electrically isolated normally open contact pairs ($K1_1$,$K1_2$) closeable by energization of said first contactor coil, a first of said contact pairs being connected between said first bus conductor and the second of said electrical nodes;

a second electrical rectifier (CR2) having a pair of alternating current terminals and a pair of direct current terminals (+ −), the direct current terminals being connected with said brake release winding;

second electrical contact means including a pair of electrically isolated normally open contact pairs ($K2_1$,$K2_2$) closeable by energization of a second contactor coil at a pair of terminals thereof, a first of said contact pairs being connected between said first bus conductor an one of said second rectifier alternating current terminals, the second of said contact pairs being connected between said second bus conductor and the remaining one of said second rectifier alternating current terminals, one of said second contactor coil terminals being connected to said bus;

a third bus conductor (B3) selectably connectable with said second bus conductor;

a second manually closeable spring return switch member (S2) electrically connected between said first and third bus conductors, and electrically shunted by the second of said first contact means contact pairs ($K1_2$);

a third electrical rectifier (CR3) having a pair of alternating current terminals and a pair of direct current terminals, the direct current terminals being connected with said brake hold off winding;

an electrical resistance member (R2) of predetermined electrical resistance connected in series with said third rectifier direct current terminals and said brake hold off winding;

time delay means (TDR) having a pair of actuating terminals connected with said second and third bus conductors and a normally closed contact pair which opens after a delay time, said contact pair being series electrically connected between said third bus and the second terminal of said second contactor coil.

2. The apparatus of claim 1 wherein said release winding (W1) and said hold off winding (W1) have a common terminal and said second and third rectifiers (CR2,CR3) have a common terminal connected with said winding common terminal.

3. The apparatus of claim 2 further including an adjustable electrical resistor (R1) series connected between one direct current terminal of said first electrical rectifier and said clutch engagement winding (W1).

4. The apparatus of claim 3 further including a first electrical current responsive circuit breaker (CB1) connected between said first supply terminal (T1) and said first bus conductor (B1).

5. The apparatus of claim 4 further including a second electrical current responsive circuit breaker (CB2) connected between said first bus conductor and said first electrical contact means first contact pair.

6. The apparatus of claim 5 wherein said electrical rectifiers (CB1-CB3) are full wave diode bridge rectifiers.

7. The apparatus of claim 6 wherein said delay time is one half second in duration.

8. Pulling apparatus comprising:

an electrically energized winch having a retractable and flexible pulling member engaged with a movable takeup drum, an electrical drive motor connected with said takeup drum, an electrically operable clutch located intermediate said drive motor and takeup drum, and a direct current operable brake having a brake release coil, a brake holdoff coil and magnetically actuated brake mechanical components;

a source of alternating current energy for operating said winch motor, clutch and brake; and energy conducting means for energizing said brake release coils during movement of said retractable flexible pulling member, said energy conducting means including:

first rectifier means conducting a first rectified, predetermined duration, current to said brake release coil for moving said brake mechanical components to the release position thereof while surmounting brake mechanical inertia and magnetic circuit air gap;

second rectifier means conducting a second rectified smaller current to said brake holdoff coil for generating brake holdoff force capable of maintaining said brake released condition during elected movement of said flexible retractable pulling member; and means conducting a third, half-wave rectified current from a combination of said first and second rectifier means to said brake release coil for supplementing said brake holdoff coil force in maintaining said brake released condition.

9. The apparatus of claim 8 wherein said first and second rectifier means include full-wave bridge rectifier connected diode elements and wherein said means conducting third half-wave rectified current includes a portion of said first and second rectifier means bridge rectifier diode elements.

10. The apparatus of claim 9 wherein said first and second rectifier means include full-wave bridge rectifiers connected directly across terminals of each said brake release coil and said brake holdoff coil and further including switching means located between said rectifiers and said source of alternating current energy for controlling the operation of said coils;

whereby said bridge rectifiers afford an inductive energy current flow path between said terminals of said coils upon interruption of coil current flow by said switching means.

* * * * *